US006981634B2

(12) United States Patent
Ogawa

(10) Patent No.: US 6,981,634 B2
(45) Date of Patent: Jan. 3, 2006

(54) KEYSTROKE TRAPPING SYSTEM, KEYSTROKE TRAPPING METHOD AND KEYSTROKE TRAPPING PROGRAM

(75) Inventor: Katsuya Ogawa, Kanagawa (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

(21) Appl. No.: 10/692,849

(22) Filed: Oct. 27, 2003

(65) Prior Publication Data

US 2004/0084516 A1 May 6, 2004

(30) Foreign Application Priority Data

Oct. 28, 2002 (JP) ..... 2002-312953

(51) Int. Cl.
*G07G 1/00* (2006.01)

(52) U.S. Cl. ..... 235/12; 235/15

(58) Field of Classification Search ..... 235/12, 235/15

See application file for complete search history.

(56) References Cited

U.S. PATENT DOCUMENTS 4,345,315 A * 8/1982 Cadotte et al. ..... 705/10
4,428,024 A * 1/1984 Mochida et al. ..... 361/172
4,935,608 A * 6/1990 Tanaka ..... 235/380
5,363,296 A * 11/1994 Fuyama ..... 705/18

FOREIGN PATENT DOCUMENTS

JP 4-195497 A 7/1992
JP 4-217099 A 8/1992

* cited by examiner

*Primary Examiner*—Diane I. Lee
*Assistant Examiner*—Lisa M. Caputo
(74) *Attorney, Agent, or Firm*—Sughrue Mion, PLLC

(57) ABSTRACT

A false act of a clerk at a store is monitored at a host computer under utilization of a communication network by detecting a false key operation in reference to a count which can be flexibly set in an item sales register or the like. The sales processing unit reads out in sequence the stored function numbers, collates them with the function numbers of the depressing limit in sequence, and if the result shows a coincided state, the sales processing unit adds 1 to the limit counter of the corresponding key, compares the value of the limit counter of the corresponding key with the corresponding limit count of the depressing limit master, and if the value of the limit counter exceeds the limit count, the sales processing unit outputs to the communication unit an instruction that the fact showing of the depressing action of the corresponding key exceeded the limit count is sent to the host computer, and causes the communication unit to send it. In addition, an instruction for displaying an alarm at the screen display unit indicating that the depressing of the corresponding key exceeds the limit count is issued and this is displayed at the display.

12 Claims, 7 Drawing Sheets

FIG. 2

| | | | | |
|---|---|---|---|---|
| 801 TENDER | | 807 NO SALE | | |
| 802 | | PAID RECALL 805 | CURSOR UP | CURSOR DOWN |
| TUNA ROLL | APPLE JUICE | CLEAR | ROLL DOWN | ROLL UP |
| 808 | 806 | 7 | 8 | 9 |
| TRAN. VOID | VOID | 4 | 5 | 6 |
| | CANCEL | 1 | 2 | 3 |
| | 804 | 0 | 803 | |

FIG. 5

601 DEPARTMENT DATA

| |
|---|
| TRANSACTION NO. |
| DEPARTMENT |
| POSITIVE/NEGATIVE |
| QUANTITY |
| AMOUNT |
| PLU CODE |
| PLU INDEX NO. |
| FUNCTION NO. |
| ITEM DISCOUNT |
| SUBTOTAL DISCOUNT |
| PRICE |
| WEIGHT |

602 HEADER

| |
|---|
| TRANSACTION NO. |
| CASHIER NO. |
| TABLE NO. |
| TRANSACTION STATUS INFORMATION |
| SALES STATUS |
| NO. OF STORE |
| ITEM COUNT |
| RECEIPT ISSUE COUNT |
| TAX TYPE |
| NO. OF GUEST |
| ITEM VOID COUNT |
| ITEM VOID AMOUNT |
| TAX % |
| TAX AMOUNT |
| TAX % (VAT) |
| VAT AMOUNT |
| SUBTOTAL |
| TAX TOTAL |
| TOTAL |
| CHANGE |

603 TENDER DATA

| |
|---|
| TRANSACTION NO. |
| TENDER |
| DEPOSIT |
| CARD NO. |
| AUTHORIZATION NO. |
| EXPIRY DATE |
| CARD HOLDER |

604 DEPRESSING LIMIT MASTER

| | | |
|---|---|---|
| FUNCTION NO. | 37 | (CANCEL KEY) |
| LIMIT COUNT | 1 | |
| FUNCTION NO. | 35 | (CLEAR KEY) |
| LIMIT COUNT | 2 | |
| FUNCTION NO. | 36 | (VOID KEY) |
| LIMIT COUNT | 4 | |
| FUNCTION NO. | 87 | (NO SALE KEY) |
| LIMIT COUNT | 1 | |
| FUNCTION NO. | 40 | (TRANSACTION VOID KEY) |
| LIMIT COUNT | 1 | |

KEYSTROKE TRAPPING SYSTEM, KEYSTROKE TRAPPING METHOD AND KEYSTROKE TRAPPING PROGRAM

BACKGROUND OF THE INVENTION

1. Field of the Invention

This invention relates to a keystroke trapping system, a keystroke trapping method and a keystroke trapping program, and more particularly a keystroke trapping system, a keystroke trapping method and a keystroke trapping program capable of easily monitoring a false act.

2. Description of the Related Art

An invention described in the gazette of Japanese Patent Laid-Open No. Hei 4 (1992)-195497 concerning a key-input relates to an item sales registration device comprised of a work releasing mechanism for releasing a drawer after detecting a series of input operations at a keyboard, and a cashier recording means for recording a working cashier's identification information inputted through the keyboard, wherein the invention is comprised of a cashier input means for inputting a work cashier's identification information; a private releasing mechanism for releasing the drawer in response to a coincidence between an identification information inputted through the cashier input means and an identification information recorded at the cashier recording means; a releasing counter for sensing an operation of the private releasing mechanism to count the count; and a releasing record means for recording the detected count of the releasing counter together with the work cashier's identification information.

In addition, an invention described in the gazette of Japanese Patent Laid-Open No. Hei 4 (1992)-217099 concerning an input error is comprised of an input error detecting means at an input means; correcting means for correcting an entry inputted through said input means; and informing means for informing this status when the entry is corrected by said correcting means in the case that the input error is not detected by said input error detecting means.

An invention described in the gazette of the aforesaid Japanese Patent Laid-Open No. Hei 4 (1992)-195497 shows a problem that only a false act concerning a releasing of the drawer can be detected.

In addition, an invention described in the gazette of Japanese Patent Laid-Open No. Hei 4 (1992)-217099 shows a problem that there is no flexibility in the count because an alarm is produced when the count upon depressing of the clear key becomes twice under no error condition. In addition, it shows another problem that its management is not sufficiently carried out because no alarm is communicated to a host computer.

SUMMARY OF THE INVENTION

It is an object of the present invention to solve the aforesaid prior art problems in the item sales registration in a POS terminal system and the like, detect a false key operation in reference to the times that can be set in a flexible manner and monitor a false of a store worker at a host computer through utilization of a communication network.

The keystroke trapping system of the present invention, comprising:

a first means for adding 1 to a limit counter of a depressed function key corresponding to a function number;

a second means for comparing value of the limit counter of the function key corresponding to the function number with a corresponding limit count.

The keystroke trapping method of the present invention, comprising:

a first step for adding 1 to a limit counter of a depressed function key corresponding to a function number;

a second step for comparing value of the limit counter of the function key corresponding to the function number with a corresponding limit count.

The keystroke trapping program for causing a computer to perform a process of the present invention, comprising:

a first step for adding 1 to a limit counter of a depressed function key corresponding to a function number;

a second step for comparing value of the limit counter of the function key corresponding to the function number with a corresponding limit count.

BRIEF DESCRIPTION OF THE DRAWINGS

The above and other objects, features and advantages of the present invention will become apparent from the following detailed description when taken with the accompanying drawings in which:

FIG. 2 is a block diagram for showing details of one example of a keyboard.

FIG. 5 is an illustrative view for showing the contents of the sales data.

DETAILED DESCRIPTION OF THE PREFERRED EMBODIMENTS

Figure 1:
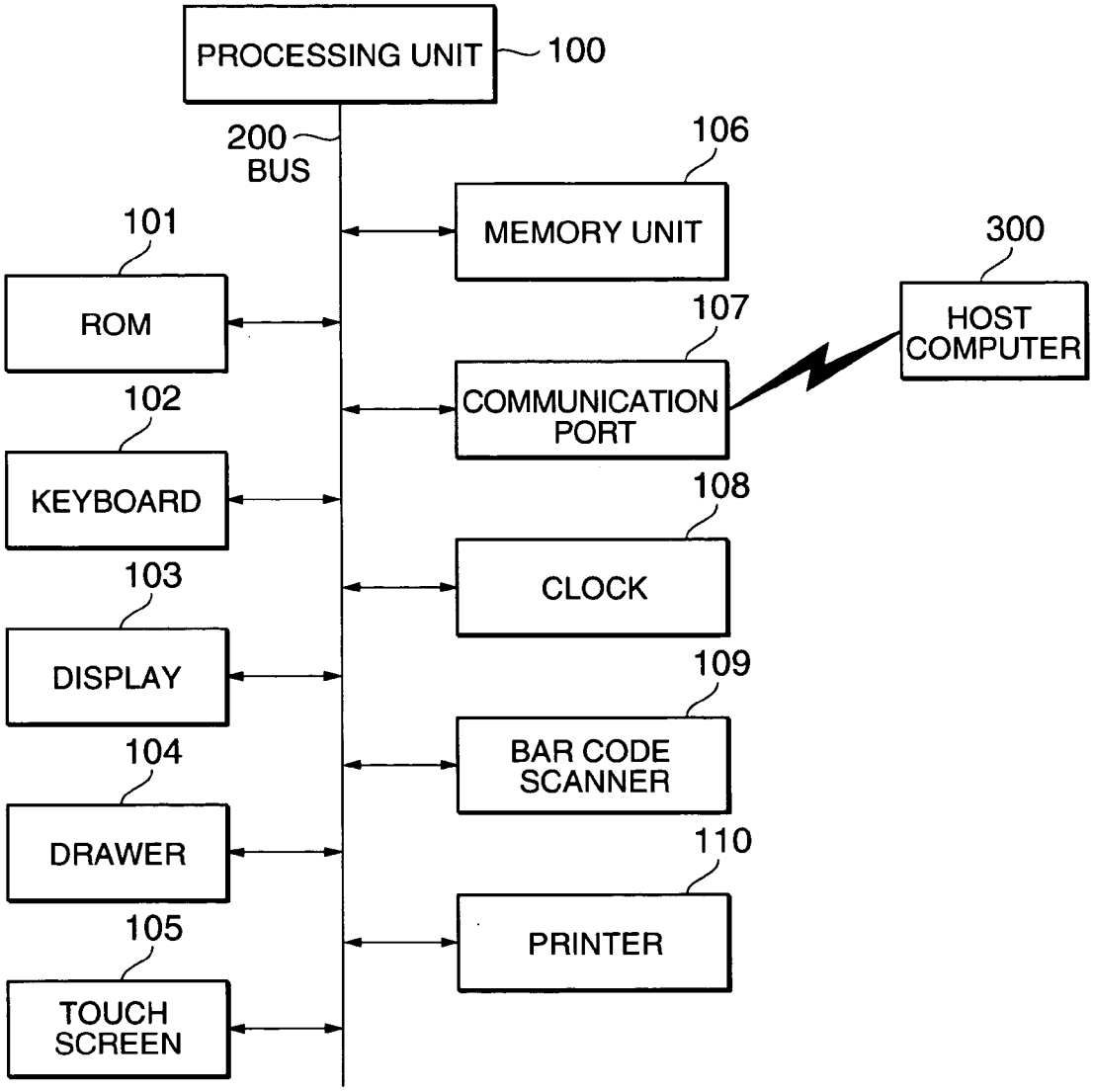
FIG. 1 is a block diagram for showing a first preferred embodiment of the present invention.

Referring to FIG. 1, the first preferred embodiment of the present invention is comprised of a processing unit 100 acting as a processor and the like; ROM 101 (Read-Only-Memory); a keyboard 102; a display 103; a drawer 104; a touch screen 105; a memory unit 106 (memory, hard-disk and the like) storing a depressing limit master 604 and sales data; a communication port 107; a clock 108; a bar-code scanner 109; a printer 110; a bus 200 connecting the processing unit 100, ROM 101, keyboard 102, display 103, drawer 104, touch screen 105, memory unit 106, communication port 107, clock 108, bar-code scanner 109 and printer 110 to each other; and a host computer 300.

A constitution other than the host computer 300 can be realized as a POS terminal installed at a store.

In addition, the host computer 300 is meant by a computer set at a headquarter of chain stores and the like and is used for collecting precise data per day at each of the stores or sending the data to the POS terminal of each of the stores and the like when a menu is changed. If a computer for use in collecting and delivering data is present in a store, the computer becomes the host computer 300.

Referring now to FIG. 2, the keyboard 102 includes a Tender key 801, Department key 802, Ten-keys 803 and some function keys (Cancel key 804, Clear key 805, Void key 806, No Sale key 807, Transaction Void key 808 and the like).

Cancel key 804 is a key for canceling the sales processing. That is, Cancel key 804 is a key for use in canceling a registration of all the items during a time in which a customer is registering the items to be purchased.

Clear key 805 is a key for use in canceling a registration of the items registered just before it. This cancel key enables an operator to cancel an erroneous depressed information (depressed just before it) because the erroneous depressing action for the key is frequently carried out under application of this system. Only the registration of the item just before it can be cancelled through this key.

Void key 806 is a key for use in canceling the registration of the items registered during sales work. Different from Clear key 805, Void key 806 can cancel every items being sold, so that sometimes this key is also called as an item correction key.

No Sale key 807 is a key for forcedly releasing the drawer 104. Normally, the drawer 104 is released to open after processing of the counting act. However, it is sometimes happened in the practical situation at a store that the sales are not made, but only releasing of the drawer 104 is required for exchanging money and the like. For performing such an operation as above, this key is provided.

Transaction Void key 808 is utilized when it is desired to correct a bill once counted. For example, when the count is already finished while one item is not counted, depressing this key enables an operation to be carried out for calling up a target transaction information stored in the memory unit 106, newly adding a lacked item and counting it again.

Figure 3:
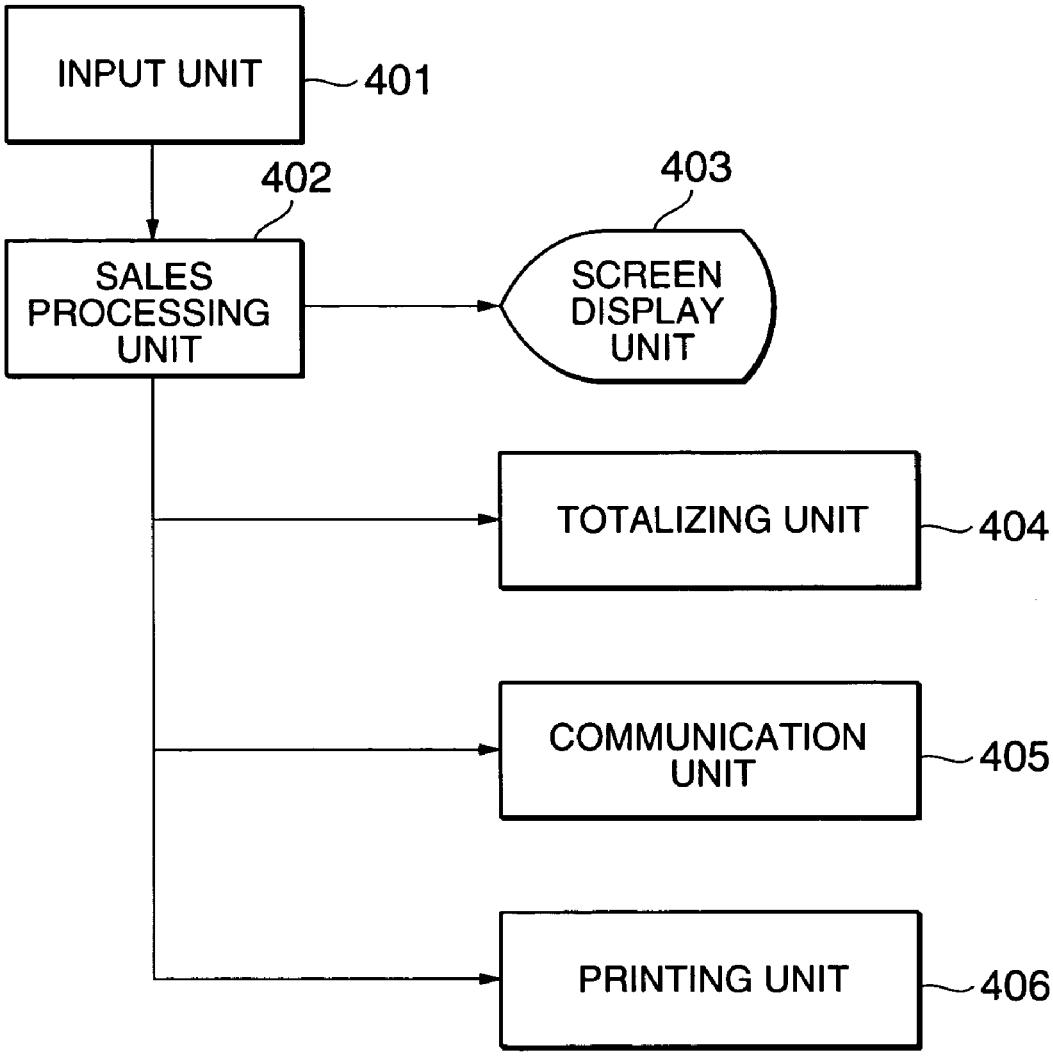
FIG. 3 is a block diagram for showing details of a processing unit.

Referring next to FIG. 3, the processing unit 100 is constituted by an input unit 401, sales processing unit 402, screen display unit 403, totalizing unit 404, communication unit 405 and printing unit 406.

Next, referring to the drawings, an operation of the first preferred embodiment of the present invention will be described.

At first, a case (case 1) having all the items of a customer already completed for registration will be described.

Figure 4:
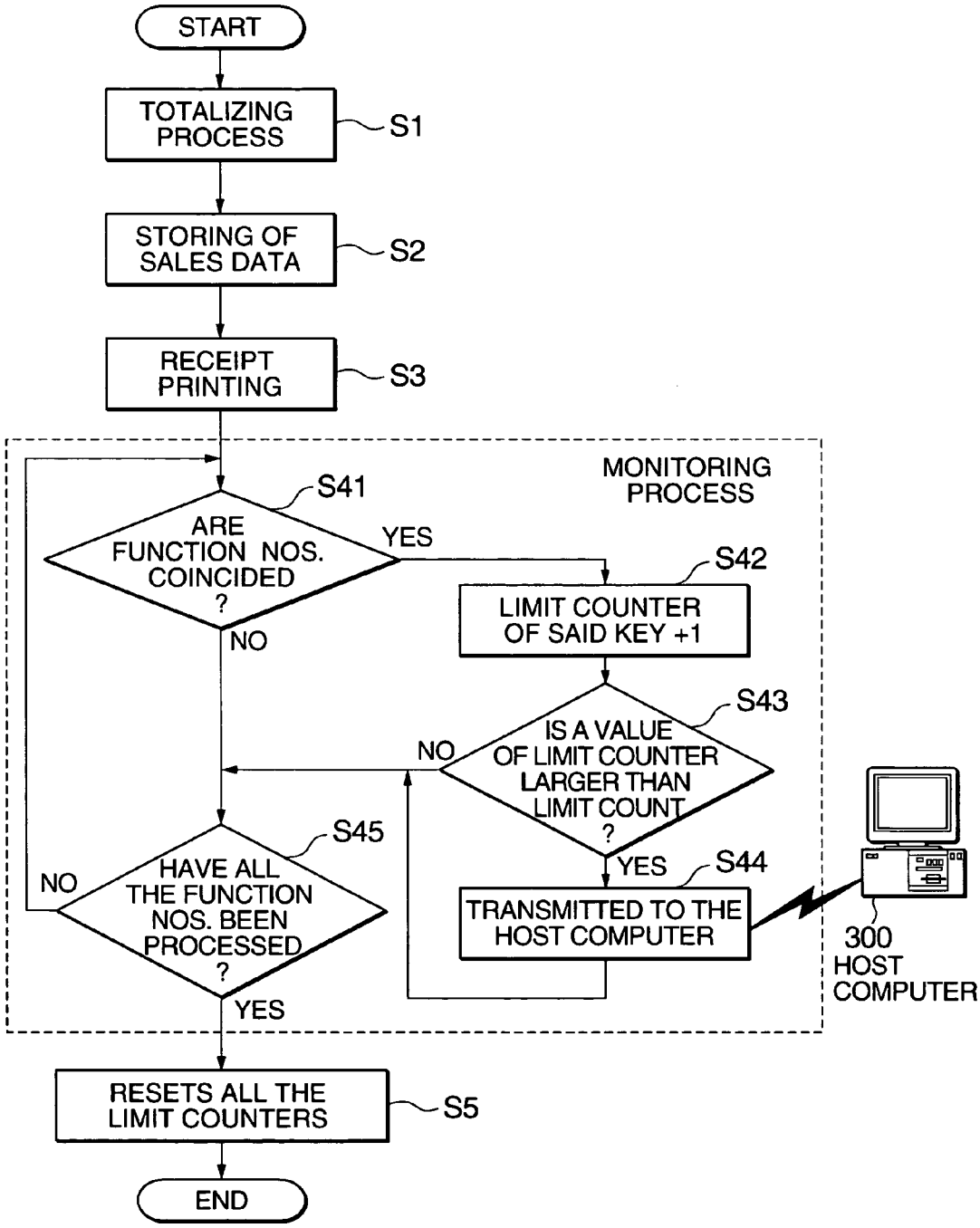
FIG. 4 is a flowchart for showing an operation of the first preferred embodiment of the present invention.

Referring to FIG. 4, when Tender key 801 (of the keyboard 102) for a tendering operation is depressed, the input unit 401 at the processing unit 100 inputs a signal from Tender key 801 and outputs it to a sales processing unit 402.

The sales processing unit 402 instructs the totalizing process against the totalizing unit 404. The totalizing unit 404 totalizes counting data (an item name, number of items, price, price × number of items purchased by a customer) registered and stored in the memory unit 106 in response to an instruction from the sales processing unit 402 so as to perform the totalizing process for generating the sales data including the total amount (a step S1 in FIG. 4). Then, the sales processing unit 402 stores the sales data generated by the totalizing unit 404 in the memory unit 106 (a step S2).

Referring to FIG. 5, the sales data includes a department data 601, header 602 and tender data 603. The department data 601 includes data concerning respective items registered during a registration process at the time of purchasing the item (item information, amount, quantity, function information and the like). In detail, the item data includes, for example, transaction No., department, positive/negative, quantity, amount, PLU code, PLU index No., function No., item discount, subtotal discount, price and weight or the like.

In this case, the function No. is a number corresponding to each of the depressed function keys at a practical scene corresponding to a customer. The function Nos. are recorded in an order where the corresponding keys are depressed.

In addition, the header 602 includes a total amount information having a tax and the like. In detail, the header 602 includes a transaction No., cashier No., table No., transaction status information, sales status, No. of store, item count, receipt issue count, tax type, No. of guest, item void count, item void amount, tax %, tax amount, tax % (VAT), VAT amount, subtotal, tax total, total, and change or the like, for example.

In addition, the tender data 603 includes a deposited amount from a customer or card information at the time of card vender and the like. In detail, it includes a transaction No., tender, deposit, card No., authorization No., expiry date and card holder, for example.

Then, the sales processing unit 402 outputs an instruction for printing a receipt against the printing unit 406. The printing unit 406 makes a printing data of the receipt on the basis of the sales data stored in the memory unit 106 in response to an instruction from the sales processing unit 402 and causes the printer 110 to print data on the receipt (a step S3).

Then, the sales processing unit 402 performs a monitoring process. The sales processing unit 402 reads out in sequence the function Nos. in the department data 601 on the sales data stored in the memory unit 106, and collates them in sequence with the function Nos. of the depressing limit master 604 stored in advance in the memory unit 106 (a step S41).

Figures 6, 7:
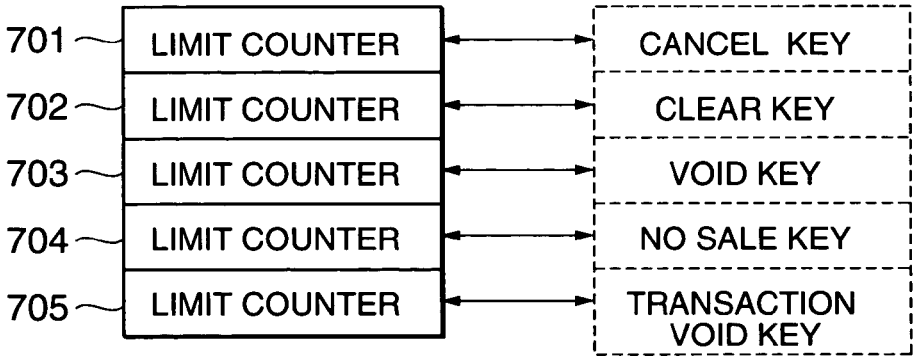
FIG. 6 is an illustrative view for showing the contents of a depressing limit master.
FIG. 7 is an illustrative view for showing details of the limit counter.

Referring to FIG. 6, each of the function Nos. of Cancel key 804, Clear key 805, Void key 806, No Sale key 807, Transaction Void key 808 in the depressing limit master 604 corresponds to "37", "35", "36", "87" and "40", respectively, and the corresponding limit counts are "1", "2", "4", "1" and "1", respectively.

The sales processing unit 402, upon coincidence as a result of function Nos. (a step S41/YES) adds 1 to the limit counter of the corresponding key in the sales processing unit 402 (a step S42).

Referring to FIG. 7, the limit counter is constituted by limit counters corresponding to all the function keys contained in the depressing limit master 604. For example, they are a limit counter 701 for the Cancel key 804; a limit counter 702 for the Clear key 805; a limit counter 703 for a Void key 806; a limit counter 704 for No Sale key 807; and a limit counter 705 for Transaction Void key 808.

Next, the sales processing unit 402 compares a value of the limit counter of the corresponding key with the corresponding limit count of the depressing limit master 604 (a step S43), and if a value of the limit counter exceeds the limit count (a step S43/YES), the sales processing unit 402 outputs against the communication unit 405 an instruction to send it to the host computer 300 that the depressing of the corresponding key exceeds the limit count. The communication unit 405 sends it to the host computer 300 through the communication port 107 that the depressing of the corresponding key exceeds the limit count under an instruction from the sales processing unit 402 (a step S44).

Next, in the case that the results of collation between the function Nos. are not coincided to each other (a step S41/NO), or in the case that a value of the limit counter does not exceed the limit count (a step S43/NO) or after performing the step S44 in FIG. 4, the sales processing unit 402 checks whether or not the processing is carried out for all the function Nos. of the department data 601 (a step S45), and if there are present not-yet-processed function Nos. (a step S45/NO), the sales processing unit 402 returns to the processing of a step S41 in FIG. 4 and executes a processing against a next function No. In addition, in the case that all the function Nos. for the department data 601 are processed (a step S45/YES), the sales processing unit 402 resets all the limit counters (a step S5).

Then, there will described a case (a case 2) in which the inputs are provided from input units such as the keyboard 102, touch screen 105 and bar-code scanner 109 or the like.

Figure 8:
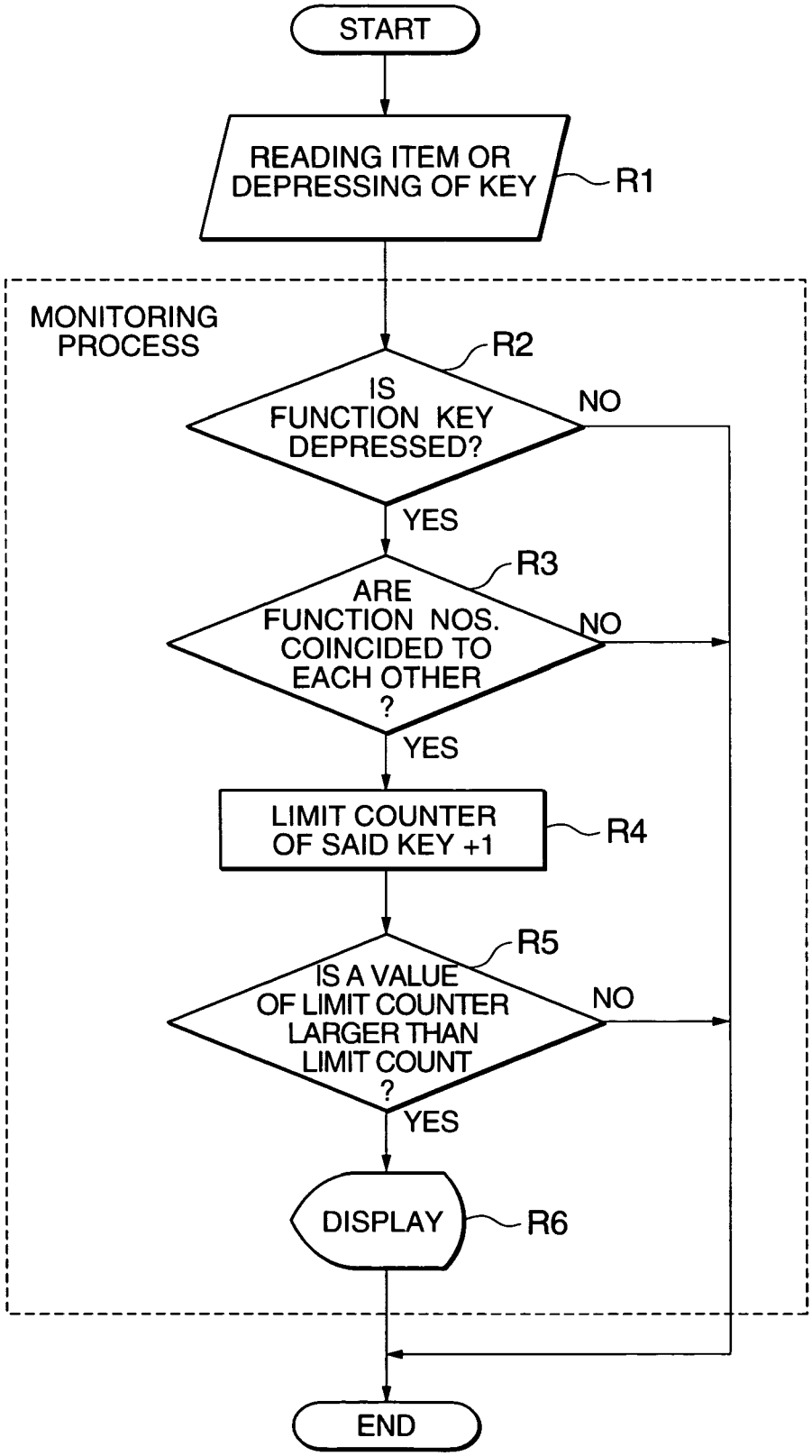
FIG. 8 is a flowchart for showing an operation of the first preferred embodiment of the present invention.

Referring to FIG. 8, the input unit 401 of the processing unit 100 inputs a signal and outputs it to the sales processing unit 402 when an inputting of the item reading or the key depressing is carried out through the keyboard 102, touch screen 105 and bar-code scanner 109 (a step R1 in FIG. 8). The sales processing unit 402 judges whether or not the depressing of the function key is present (a step R2), and if the depressing of the function key is present (a step R2/YES), it may collate the function No. corresponding to the function key (a correspondence between the function key and the function No. is given in advance as information at the sales processing unit 402) with the function No. of the depressing limit master 604 stored in advance in the memory unit 106 in sequence (a step R3).

The sales processing unit 402 adds 1 to the limit counter of the corresponding key in the sales processing unit 402 (a step R4) when the results of collation of the function numbers are coincided to each other (a step R3/YES).

Next, the sales processing unit 402 compares the value of the limit counter of the corresponding key with the corresponding limit count of the depressing limit master 604 (a step R5) and if the value of the limit counter exceeds the limit count (a step R5/YES), it outputs against the screen display unit 403 an instruction for displaying that the depression of the corresponding key exceeds the limit count. The screen display unit 403 displays it under an instruction from the sales processing unit 402 at the display 103 or the like that the depressing of the corresponding key exceeds the limit count (a step R6).

It is efficient that the aforesaid cases 1 and 2 are exclusively applied.

Next, a second preferred embodiment of the present invention will be described in detail in reference to the drawings as follows.

The second preferred embodiment of the present invention is a method including each of the steps shown in FIG. 4 or FIG. 8 as its procedure.

Next, a third preferred embodiment of the present invention will be described in detail in reference to the drawings.

The third preferred embodiment of the present invention is a program to cause the computer (for example, the processing unit 100) to execute each of the procedures of the second preferred embodiment of the present invention.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A keystroke trapping system comprising:

a first means for reading out, in sequence, function numbers in sales data stored in a memory unit, collating them with function numbers in a depressing limit master stored in the memory unit in sequence, and when they are coincided to each other, adding 1 to a limit counter of the depressed function key corresponding to the function number;

a second means for comparing a value of the limit counter of the function key corresponding to the function number with the corresponding limit count in the depressing limit master;

a third means for sending it to a host computer that the depressing of the key corresponding to the function number exceeds the limit count if the value of the limit counter exceeds the limit count;

a fourth means for resetting the limit counter.

2. A keystroke trapping system comprising:

a first means for collating in sequence function numbers in a depressing limit master stored in a memory unit when an input from an input unit corresponds to a depressed function key, if they are coincided to each other, adding 1 to a limit counter of the depressed function key corresponding to the function number;

a second means for comparing a value of the limit counter of the function key corresponding to the function number with a corresponding limit count in the depressing limit master;

a third means for displaying that the depressing of the key corresponding to the function number exceeds the limit count if the value of the limit counter exceeds the limit count.

3. A keystroke trapping system comprising:

a first means for reading out, in sequence, function numbers corresponding to a Cancel key, Clear key, Void key, No Sale key and Transaction Void key in sales data stored in a memory unit, collating the function numbers in a depressing limit master stored in the memory unit in sequence, and if they are coincided to each other, adding 1 to a limit counter of a depressed function key corresponding to the function number;

a second means for comparing a value of the limit counter of the function key corresponding to the function number with a corresponding limit count in the depressing limit master;

a third means for sending it to a host computer that the depressing of the key corresponding to the function number exceeds the limit count if the value of the limit counter exceeds the limit count;

a fourth means for resetting the limit counter.

4. A keystroke trapping system comprising:

a first means for collating function numbers in a depressing limit master stored in a memory unit in sequence when an input from an input unit corresponds to the function keys including a Clear key, Void key, No Sale key and Transaction Void key, and if they are coincided to each other, adding 1 to a limit counter of the depressed function key corresponding to the function number;

a second means for comparing a value of the limit counter of the function key corresponding to the function number with a corresponding limit count in the depressing limit master;

a third means for displaying that the depressing of the key corresponding to the function number exceeds the limit count if the value of the limit counter exceeds the limit count.

5. A keystroke trapping method comprising:

a first step of reading out, in sequence, function numbers in sales data stored in a memory unit, collating them with function numbers stored in a depressing limit master stored in a memory unit in sequence, and if they are coincided to each other, adding 1 to a limit counter of the depressed function key corresponding to the function number;

a second step of comparing the value of the limit counter of the function key corresponding to the function number with a corresponding limit count in the depressing limit master;

a third step of sending it to a host computer that the depressing of the key corresponding to the function number exceeds the limit count if the value of the limit counter exceeds the limit count;

a fourth step of resetting the limit counter.

6. A keystroke trapping method comprising:

a first step of collating function numbers in a depressing limit master stored in a memory unit in sequence if an input from an input unit corresponds to a depressed function key, and if they are coincided to each other, adding 1 to a limit counter of the depressed function key corresponding to the function number;

a second step of comparing the value of the limit counter of the function key corresponding to the function number with a corresponding limit count in the depressing limit master;

a third step of displaying that the depressing of the key corresponding to the function number exceeds the limit count if the value of the limit counter exceeds the limit count.

7. A keystroke trapping method comprising:

a first step of reading out, in sequence, function numbers corresponding to a Cancel key, Clear key, Void key, No Sale key and Transaction Void key in sales data stored in a memory unit, collating the function numbers in a depressing limit master stored in the memory unit in sequence, and if they are coincided to each other, adding 1 to a limit counter of a depressed function key corresponding to the function number;

a second step of comparing the value of the limit counter of the function key corresponding to the function number with a corresponding limit count in the depressing limit master;

a third step of sending it to a host computer that the depressing of the key corresponding to the function number exceeds the limit count if the value of the limit counter exceeds the limit count;

a fourth step of resetting the limit counter.

8. A keystroke trapping method comprising:

a first step of collating function numbers in a depressing limit master stored in a memory unit in sequence when an input from an input unit corresponds to the function keys including a Clear key, Void key, No Sale key and Transaction Void key, and if they are coincided to each other, adding 1 to a limit counter of the depressed function key corresponding to the function number;

a second step of comparing a value of the limit counter of the function key corresponding to the function number with a corresponding limit count in the depressing limit master;

a third step of displaying that the depressing of the key corresponding to the function number exceeds the limit count if the value of the limit counter exceeds the limit count.

9. A keystroke trapping program for causing a computer to perform a process, comprising:

a first step of reading out, in sequence, function numbers in sales data stored in a memory unit, collating them with function numbers stored in a depressing limit master stored in a memory unit in sequence, and if they are coincided to each other, adding 1 to a limit counter of the depressed function key corresponding to the function number;

a second step of comparing the value of the limit counter of the function key corresponding to the function number with a corresponding limit count in the depressing limit master;

a third step of sending it to a host computer that the depressing of the key corresponding to the function number exceeds the limit count if the value of the limit counter exceeds the limit count;

a fourth step of resetting the limit counter.

10. A keystroke trapping program for causing a computer to perform a process, comprising:

a first step of collating function numbers in a depressing limit master stored in a memory unit in sequence if an input from an input unit corresponds to a depressed function key, and if they are coincided to each other, adding 1 to a limit counter of the depressed function key corresponding to the function number;

a second step of comparing the value of the limit counter of the function key corresponding to the function number with a corresponding limit count in the depressing limit master;

a third step of displaying that the depressing of the key corresponding to the function number exceeds the limit count if the value of the limit counter exceeds the limit count.

11. A keystroke trapping program for causing a computer to perform a process, comprising:

a first step of reading out, in sequence, function numbers corresponding to a Cancel key, Clear key, Void key, No Sale key and Transaction Void key in sales data stored in a memory unit, collating the function numbers in a depressing limit master stored in the memory unit in sequence, and if they are coincided to each other, adding 1 to a limit counter of the depressed function key corresponding to the function number;

a second step of comparing the value of the limit counter of the function key corresponding to the function number with a corresponding limit count in the depressing limit master;

a third step of sending it to a host computer that the depressing of the key corresponding to the function number exceeds the limit count if the value of the limit counter exceeds the limit count;

a fourth step of resetting the limit counter.

12. A keystroke trapping program for causing a computer to perform a process, comprising:

a first step of collating function numbers in a depressing limit master stored in a memory unit in sequence when an input from an input unit corresponds to the function keys including a Clear key, Void key, No Sale key and Transaction Void key, and if they are coincided to each other, adding 1 to a limit counter of depressed function key corresponding to the function number;

a second step of comparing a value of the limit counter of the function key corresponding to the function number with a corresponding limit count in the depressing limit master;

a third step of displaying that the depressing of the key corresponding to the function number exceeds the limit count if the value of the limit counter exceeds the limit count.

* * * * *